US008464865B1

(12) United States Patent
DuMont et al.

(10) Patent No.: US 8,464,865 B1
(45) Date of Patent: Jun. 18, 2013

(54) TRANSACTION CARD HOLDER FOR DISPENSING AND RETRACTING CARDS WITHIN ITSELF

(76) Inventors: Maurice DuMont, Fall River, MA (US); Gregory Dawson, Assonet, MA (US)

( * ) Notice: Subject to any disclaimer, the term of this patent is extended or adjusted under 35 U.S.C. 154(b) by 0 days.

(21) Appl. No.: 13/199,594

(22) Filed: Sep. 2, 2011

Related U.S. Application Data

(60) Provisional application No. 61/402,636, filed on Sep. 3, 2010.

(51) Int. Cl.
*A47G 29/10* (2006.01)

(52) U.S. Cl.
USPC ..... 206/37

(58) Field of Classification Search
USPC ..... 206/39, 37, 39.1, 39.4, 38, 38.1
See application file for complete search history.

(56) References Cited

U.S. PATENT DOCUMENTS

| | | | | |
|---|---|---|---|---|
| 3,765,200 | A * | 10/1973 | Vogt | 70/456 R |
| 7,032,419 | B2 | 4/2006 | Booker | |
| 2005/0011776 | A1 | 1/2005 | Nagel | |
| 2010/0005843 | A1 | 1/2010 | Aizpurua Plaza | |

OTHER PUBLICATIONS www.keyfobber.com (see attached).

* cited by examiner

*Primary Examiner* — Steven A. Reynolds
*Assistant Examiner* — King M Chu

(57) ABSTRACT

A transaction card holder includes an external housing having a carrying plate that is received and retracted into the external housings internal cavity. A guide slot along the top surface of the external housing accepts a slide post therethrough which engages the carrying plate at a fixed position. Movement of the slide post along the guide slot allows for the carrying plate to be slideably engaged within the external housing. The carrying plate includes an engagement tang for easy connection and removal of transaction cards as well as a structure that facilitates easy access to cards when needed for a transaction. When the carrying plate is fully retracted into the external housing the transaction cards are stored internal to the holder. When the carrying plate is fully extended the transaction cards are easily rotated about the engagement tang both vertically and horizontally for easy visual identification of the sought after card. The carrying plate also allows for the cards to be flipped up into a stationary position to facilitate presentation of the particular card for scanning by a retail service representative.

9 Claims, 12 Drawing Sheets

TRANSACTION CARD HOLDER FOR DISPENSING AND RETRACTING CARDS WITHIN ITSELF

CROSS-REFERENCE TO RELATED APPLICATIONS

This application is a continuation of U.S. Provisional Application No. 61/402,636 filed 3 Sep. 2010

BACKGROUND OF THE INVENTION

1. Field of the Invention

The present invention relates to a transaction card holder, and specifically to a new type of holder that allows a transaction card (such as a key chain bar code card) to be dispensed from and retracted into the holder.

2. Background of the Invention

It is generally known to provide transaction cards or Bar Code cards as a means for customers to acquire a discount at a specific retail establishment who would issue the card. A typical consumer may have up to ten cards stored on a keychain or similar device. At the time of purchase of goods the card is accessed and scanned by the retail service representative. The customer would sift through their multitude of cards to find the specific card for the particular establishment. This endeavor often involves fumbling about until the card can be accessed for scanning.

The present invention provides an organized collection and dispensing holder for these cards to facilitate easy retrieval and presentation of the bar code cards when needed.

Furthermore, after the card is used the device allows for a single action retractable storage of all cards back into the holder.

SUMMARY OF THE INVENTION

Generally described, the transaction card holder of the present invention includes an external housing having a carrying plate that is received and retracted into the external housings internal cavity. A guide slot along the top surface of the external housing accepts a slide post therethrough which engages the carrying plate at a fixed position. Movement of the slide post along the guide slot allows for the carrying plate to be slideably engaged within the external housing.

The carrying plate includes an engagement tang for easy connection and removal of transaction cards as well as a structure that facilitates easy access to cards when needed for a transaction. When the carrying plate is fully retracted into the external housing the transaction cards are stored internal to the holder. When the carrying plate is fully extended the transaction cards are easily rotated about the engagement tang both vertically and horizontally for easy visual identification of the sought after card. The carrying plate also allows for the cards to be flipped up into a stationary position to facilitate presentation of the particular card for scanning by a retail service representative.

DETAIL DESCRIPTION OF THE INVENTION

Figure 1:
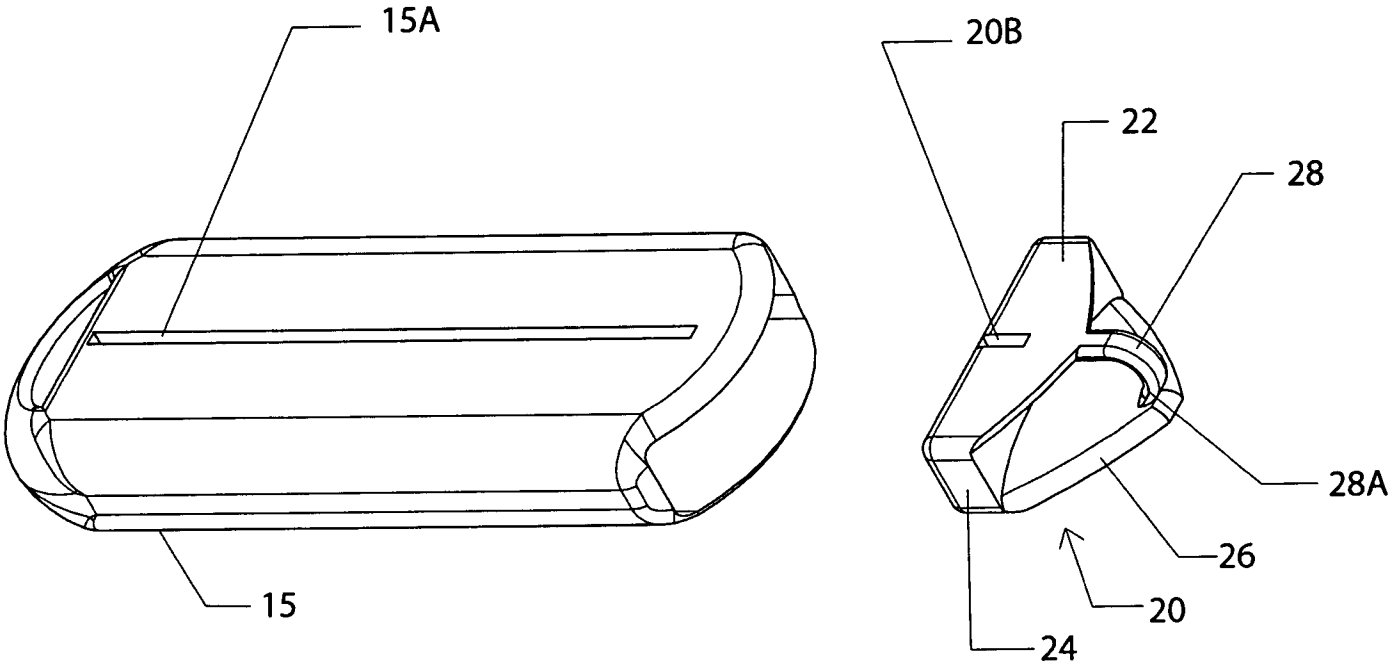
FIG. 1 is a front perspective view of the transaction card holder of the present invention, separated into an external housing and carrying plate.
Figure 2:
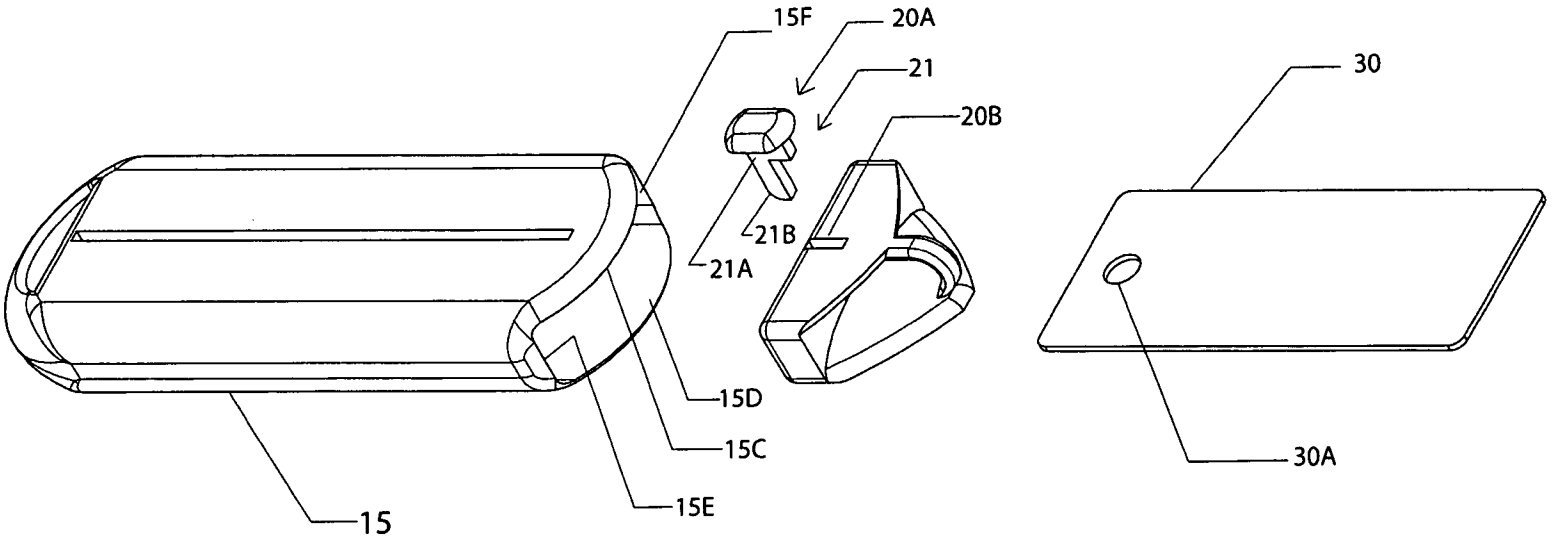
FIG. 2 illustrates the invention of FIG. 1 further showing a transaction card attached to the engagement tang of the carrying plate and further showing the slide post that engages both the external housing and carrying plate.
Figure 3:
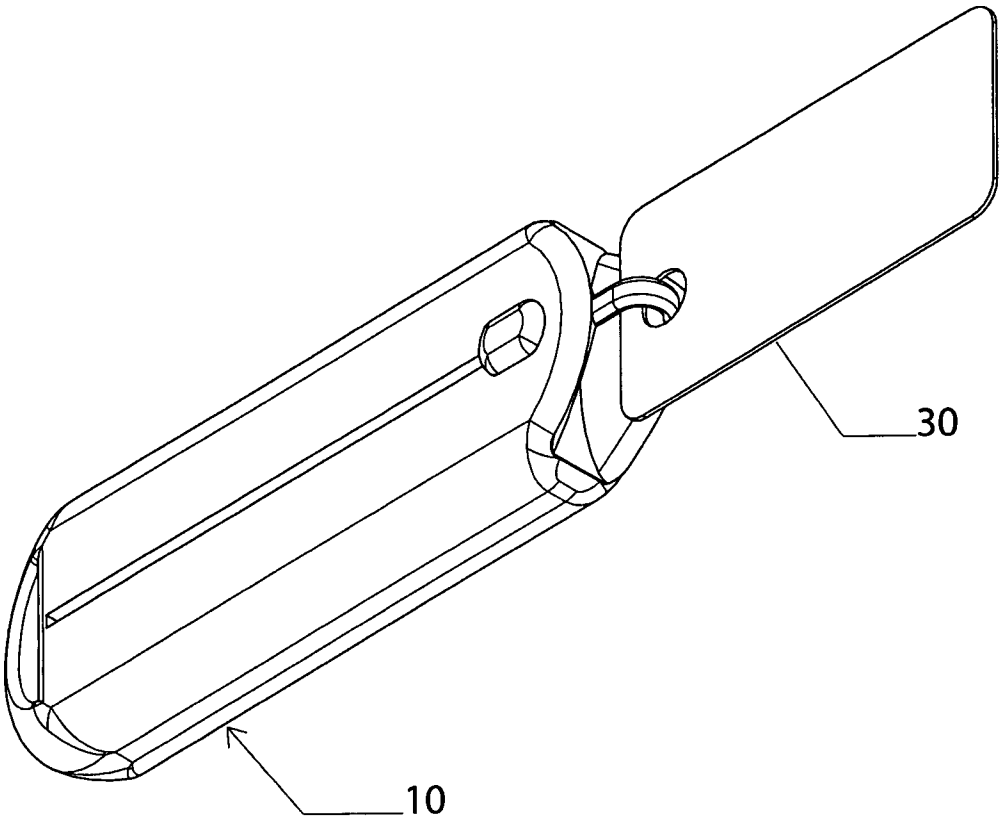
FIG. 3 is an assembled version of the invention of FIG. 2.

Referring to FIGS. 1 through 16, a transaction card holder 10 of the present invention includes an external housing 15, and a carrying plate 20 that is received and retracted into the external housings internal cavity 15B as illustrated in FIGS. 7-11. A Guide slot 15A along the top surface of external housing 15 receives a slide post 20A therethrough which engages carrying plate 20 slot 20B as illustrated in FIGS. 2, 6, 8, and 10.

Slide post 20A includes an extension 21 having a first portion 21A and a second portion 21B. Portions 21A and 21B insert into slot 20B up to a point where the side surface of portion 21A fits snugly within channel 15A and acts to secure the slide post 20A within guide slot 15A while allowing movement of the slide post along the guide slot 15A.

Movement of the slide post 20A along the guide slot allows for the carrying plate 20 to be slideably engaged within the external housing 15. The external housing 15 internal cavity 15B includes opposing top and bottom surfaces 15C and 15D and opposing first and second side surfaces 15E and 15F.

The carrying plate 20 includes a top surface 22, side surface 24 and bottom surface 26. Top surface 22 includes slot 20B at one end and extension tang 28 extending outward at the opposite end. Bottom surface 26 projects outward from side surface 24 below and extending beyond top surface 22.

Engagement tang 28 is hooked having an end portion 28A, the length of the extension tang projecting over bottom surface 26 and contacting bottom surface 26 at hooked end portion 28A. Extension tang 28 may alternatively be raised above bottom surface 26. Hooked end portion 28A is resiliently flexible to allow for a snapping engagement of transaction cards 30 at transaction card slot 30A.

Figure 4:
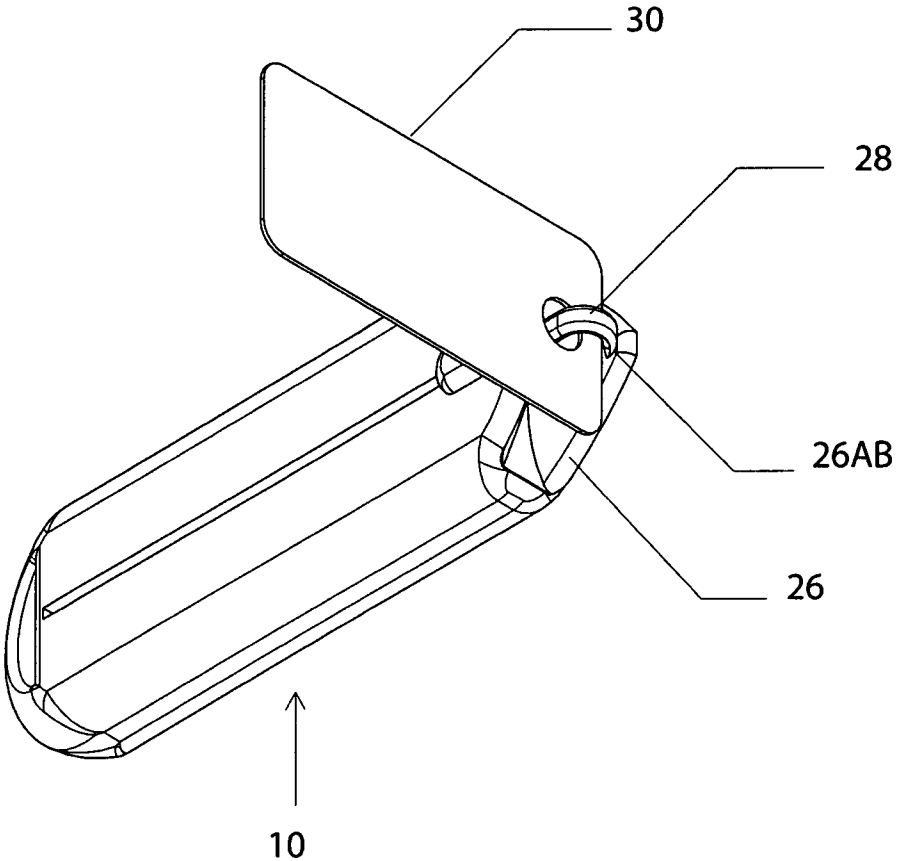
FIG. 4 illustrates the invention of FIG. 3 with a transaction card flipped up into a stationary position.
Figure 5:
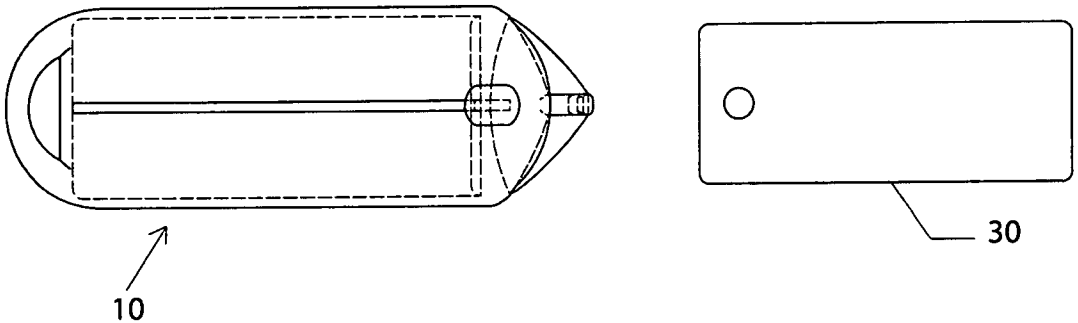
FIG. 5 illustrates a top view of the invention of FIG. 3 with the transaction card detached.
Figure 6:
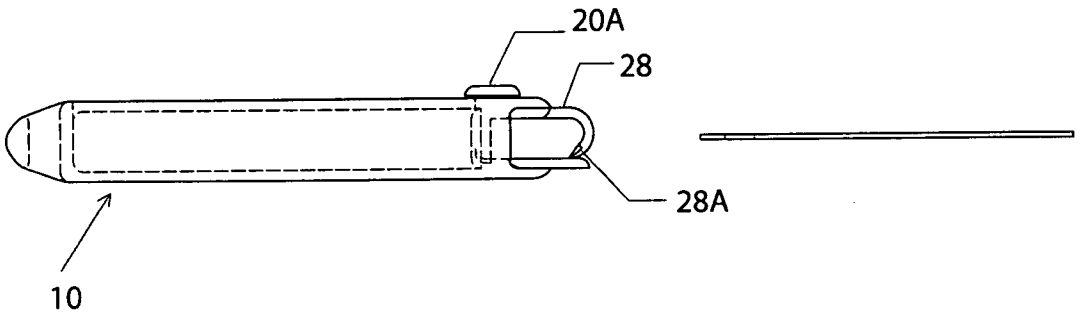
FIG. 6 illustrates a side view of FIG. 5.
Figure 7:
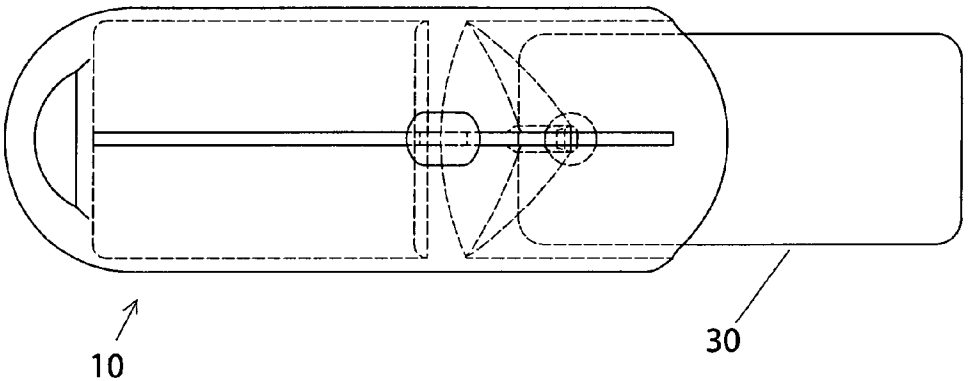
FIG. 7 illustrates a top view of the invention of FIG. 3, with dotted lines depicting hidden surfaces, showing a transaction card partially retracted.
Figure 8:
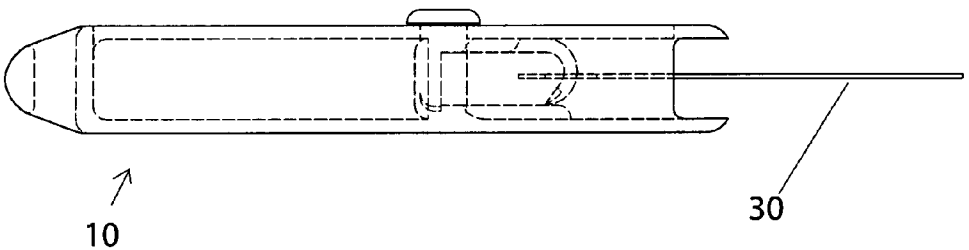
FIG. 8 is a side view of FIG. 7.

Referring to FIG. 4, after engagement of a transaction card 30 with end portion 28A, the card can be flipped up to a stationary position with one end of card 30 resting on bottom surface 26, at point 26AB. The placement of hooked end portion 28A at the edge of bottom surface 26, at point 26AB, creates surface area between the edges of top surface 22 and bottom surface 26. Effectively, top surface 22 acts as a card resting point when the card is stationary and angled at point 26AB, in a substantially vertical position.

Figure 12:
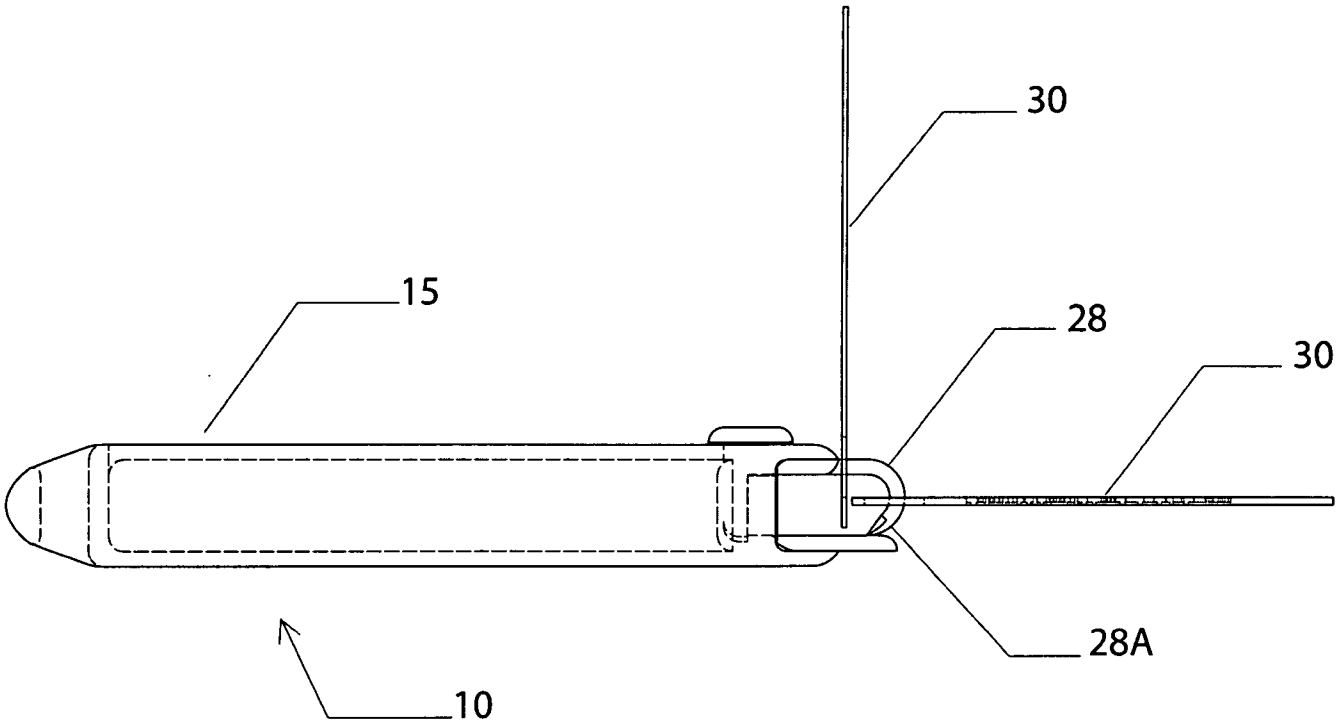
FIG. 12 illustrates the invention of FIG. 4 having two transaction cards attached.
Figure 13:
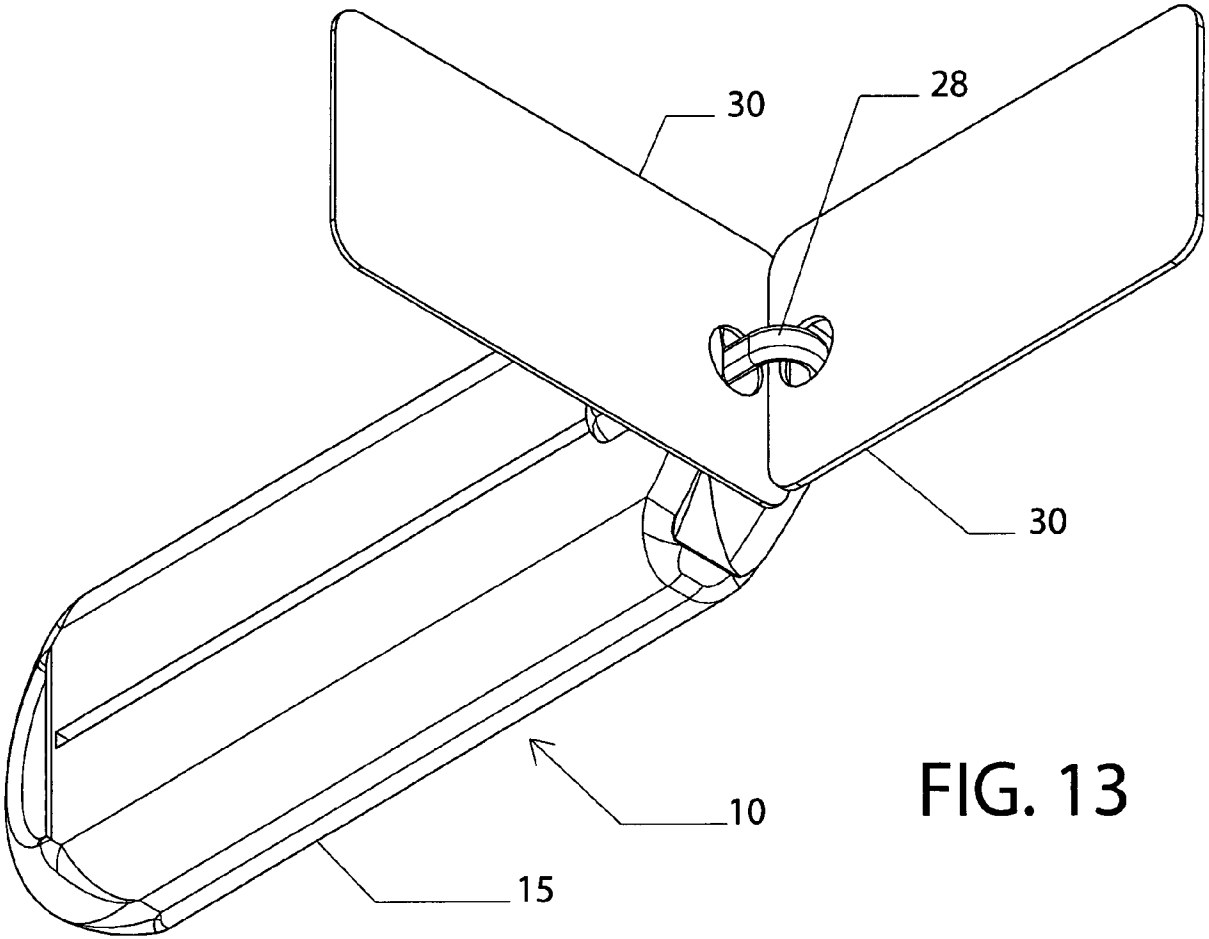
FIG. 13 is a perspective view of FIG. 12 illustrating a transaction card selected for presentation and scanning.
Figure 15:
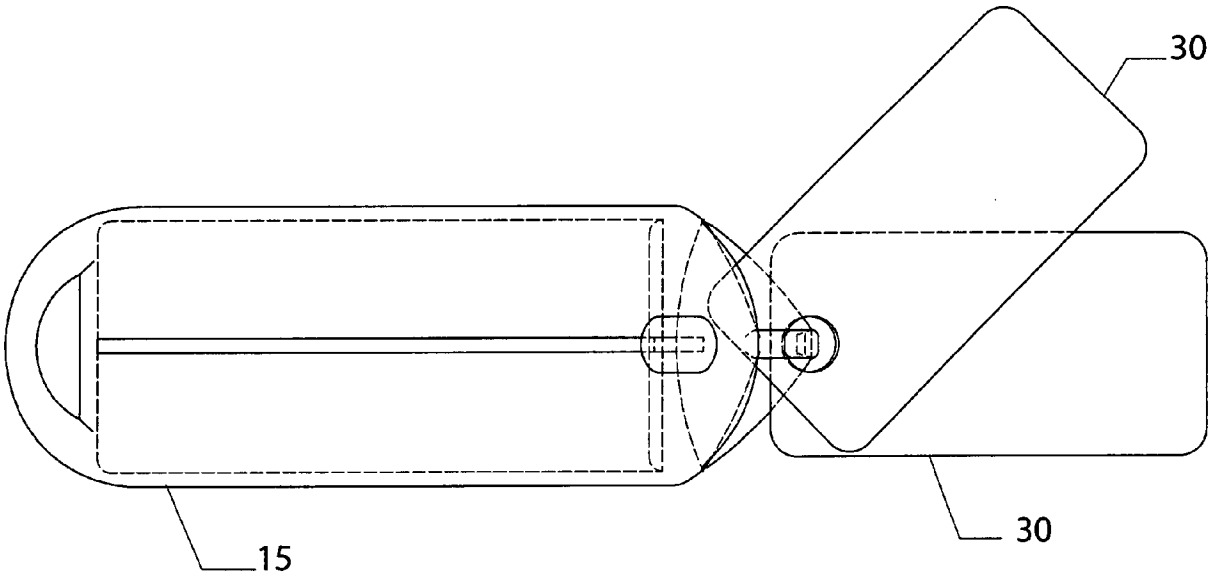
FIGS. 14 and 15 illustrate the transaction card holder of FIG. 13 showing the cards in the horizontal position to facilitate searching for a particular card.
Figure 14:
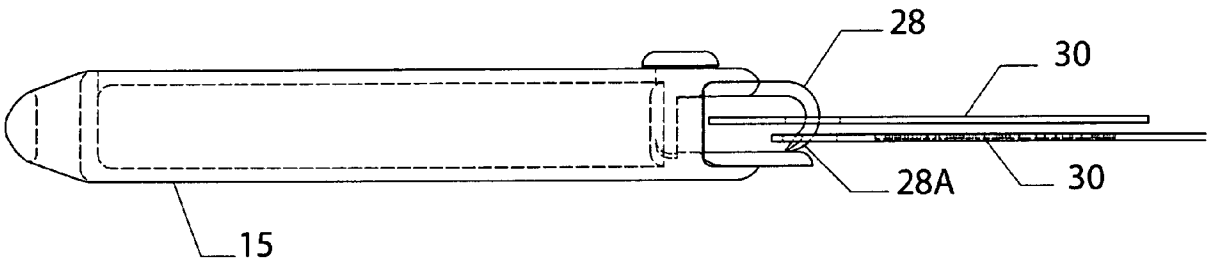
Figure 16:
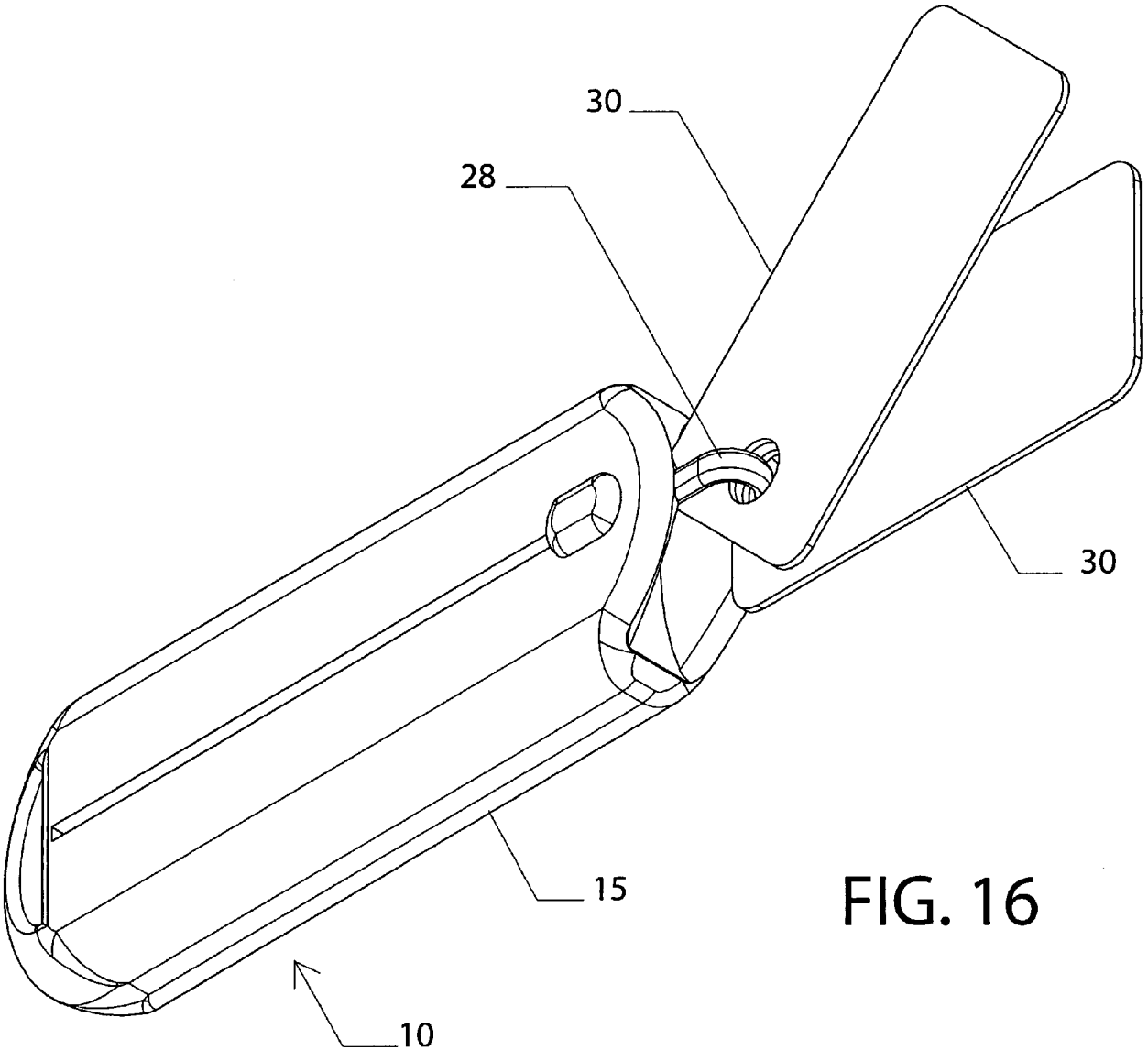
FIG. 16 illustrates a perspective view of the transaction card holder of FIGS. 14 and 15.

Referring to FIGS. 12-16, multiple transaction cards 30 may be attached at end portion 20A. As illustrated in FIGS. 12 and 13, one card can be flipped up and stationary while another card is presented for scanning. Furthermore, as illustrated in FIGS. 14-16, the placement of engagement tang 28 allows for a fanning of cards 30, in a substantially horizontal orientation, in an effort to locate a particular card. The design of the carrying plate 20 allows for the face of the cards to be visible and rotated 180 degrees about the extension tang 28.

Figure 9:
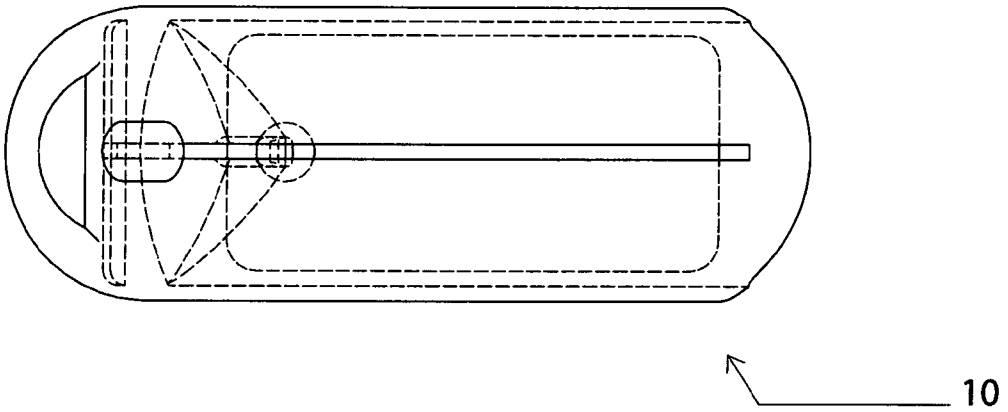
FIG. 9 illustrates the invention of FIG. 7, with the transaction card fully retracted.
Figure 10:
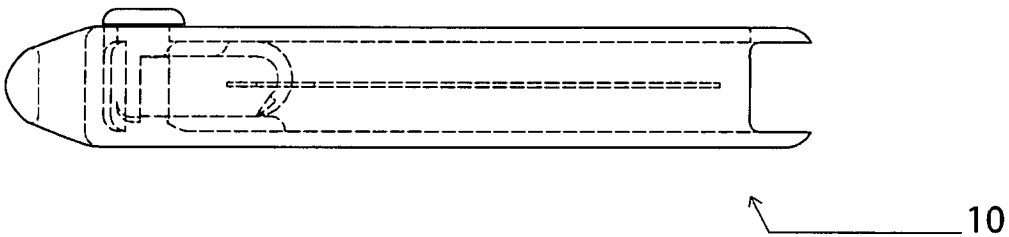
FIG. 10 illustrates a side view of FIG. 9.
Figure 11:
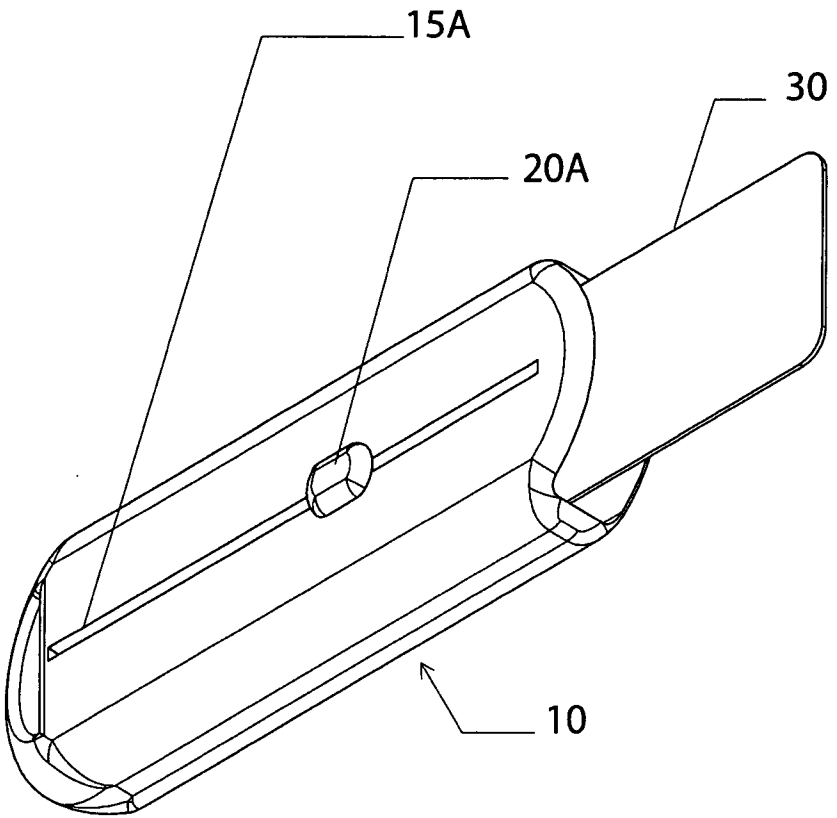
FIG. 11 illustrates the invention of FIG. 3 partially retracted.

When the carrying plate 20 is fully retracted into external housing 15 the transaction cards are stored internal to the holder 10 as illustrated in FIGS. 9 and 10. When the carrying plate 20 is fully extended the transaction cards 30 are easily rotated about the engagement tang 28 both in a substantially vertical and substantially horizontal stationary position for easy visual identification of the sought after card.

The invention may be constructed from a variety of materials such as plastic or metal, held together with metal or plastic screws or glue, or alternatively injection molded.

It is to be understood, however, that even though numerous characteristics and advantages have been set forth in the foregoing description of preferred embodiments, together with details of the structure and function, the disclosure is illustrative only, and changes may be made in detail, especially in matters of shape, size, and arrangement of parts within the principles of the invention to the full extent indicated by the broad general meaning of the terms in which the future claims are expressed

We claim:

1. A Cardholder for storing and presenting a plurality of cards, comprising:

an external housing having an internal cavity, said internal cavity having opposing top and bottom surfaces and opposing first and second side surfaces, said top surface having a longitudinally disposed guide slot;

a carrying plate adapted to slideably engage said internal cavity along said longitudinally disposed guide slot;

said carrying plate further comprising means for engaging said plurality of cards thereto, said carrying plate and said cards being fully retractable into and extendable out from said internal cavity along said longitudinally disposed guide slot, wherein said carrying plate further includes a plate top surface, a plate bottom surface, and opposing plate side surfaces, said plate top surface in slideable engagement with said internal cavity top surface, said plate bottom surface stepped down in parallel relation to said top surface, said bottom surface extending outward from below said plate top surface and in slideable engagement with said internal cavity bottom surface, and said opposing plate side surfaces in slideable engagement with said internal cavity opposing first and second side surfaces.

2. A Cardholder as in claim 1, wherein said carrying plate further includes a slide post, said slide post positioned within said guide slot and in communication with said carrying plate, said guide post movable along said guide slot for retracting said carrying plate and said cards into said cavity and extending said carrying plate and said cards out of said cavity.

3. A Cardholder as in claim 1, wherein said plate bottom surface extends outward from below said plate top surface, said plate bottom surface further extending beyond said plate top surface, said engagement means projecting outward from said top surface and over said plate bottom surface.

4. A cardholder as in claim 3, wherein said engagement means comprises an engagement tang, said engagement tang having a hooked end portion, said hooked end portion touching said plate bottom surface.

5. A Cardholder as in claim 4, wherein said hooked end portion is positioned slightly above said plate bottom surface.

6. A Cardholder as in claim 3, wherein said plurality of attached cards are rotatable about said engagement means in a substantially vertical and substantially horizontal orientation when said carrying plate is fully extended.

7. A Cardholder as in claim 6, wherein said plurality of substantially vertical attached cards can be fixed in an inclined position, said plurality of cards having one end inclined against said plate top surface and an opposite end inclined against said extended plate bottom surface.

8. A Cardholder as in claim 6, wherein said plurality of substantially horizontally attached cards can be fixed in a substantially horizontal position.

9. A cardholder as in claim 3, wherein said engagement means is resiliently flexible.

* * * * *